US005690428A

United States Patent [19]

Bryan et al.

[11] Patent Number: 5,690,428

[45] Date of Patent: Nov. 25, 1997

[54] MIXING DEVICE COMPRISING CONCENTRIC TUBES FOR SUPPLYING SOLUTIONS ONTO AND MIXING ON A ROTOR

[75] Inventors: Michael Bryan, Watford; Michael Tadeusz Gorecki, Harrow; Terry Douglas Haynes, Croxley Green, all of United Kingdom

[73] Assignee: Eastman Kodak Company, Rochester, N.Y.

[21] Appl. No.: 620,520

[22] Filed: Mar. 22, 1996

[30] Foreign Application Priority Data

Mar. 29, 1995 [GB] United Kingdom ..... 9506400

[51] Int. Cl.[6] ..... B01F 5/04

[52] U.S. Cl. ..... 366/172.1; 366/172.2; 366/178.3; 239/424; 239/427; 239/432

[58] Field of Search ..... 366/168.1, 172.1, 366/172.2, 176.1, 178.1–178.3, 315, 317; 239/419.3, 422, 424, 428, 427, 432

[56] References Cited

U.S. PATENT DOCUMENTS

| | | | |
|---|---|---|---|
| 1,626,487 | 4/1927 | Warren . | |
| 2,639,901 | 5/1953 | Teale | 366/178.3 |
| 2,641,453 | 6/1953 | Teale | 366/178.1 |
| 2,788,337 | 4/1957 | Preiswerk et al. | 239/422 X |
| 3,744,763 | 7/1973 | Schnoring et al. | 366/178.1 |
| 3,818,938 | 6/1974 | Carson . | |
| 3,998,433 | 12/1976 | Iwako | 366/478.3 |
| 4,096,587 | 6/1978 | Haller | 366/178.1 X |
| 4,175,873 | 11/1979 | Iwako et al. | 366/178.3 X |
| 4,239,396 | 12/1980 | Arribau et al. | 366/178.1 X |
| 5,018,871 | 5/1991 | Brazelton et al. | 366/178.3 X |
| 5,213,772 | 5/1993 | Ichikawa et al. . | |

FOREIGN PATENT DOCUMENTS

| | | | |
|---|---|---|---|
| 04/139440 | 5/1992 | Japan . | |
| 1606203 | 11/1990 | U.S.S.R. | 366/178.1 |

*Primary Examiner*—Charles E. Cooley
*Attorney, Agent, or Firm*—Arthur H. Rosenstein

[57] ABSTRACT

Photographic emulsions comprise silver halide grains which are generally produced by reacting an aqueous silver salt solution, and an aqueous halide solution in an aqueous gelatin solution in a reaction vessel. However, it may often be difficult to control the formation of the grains to produce consistent and reproducible emulsions. Described herein is an improved nucleation device for mixing photographic emulsions. The device has three inlets through which the silver salt solution, the halide solution and the gelatin are introduced into the device. The inlets are respectively connected to tube member and passages, the tube member and passages being concentrically disposed about an axis. Solutions from the tube member and passage impinge on a rotating rotor in a first mixing zone. Solution from passage mixes with the mixture from the first mixing zone at a second mixing zone spaced therefrom.

2 Claims, 2 Drawing Sheets

MIXING DEVICE COMPRISING CONCENTRIC TUBES FOR SUPPLYING SOLUTIONS ONTO AND MIXING ON A ROTOR

FIELD OF THE INVENTION

The present invention relates to nucleation devices and is more particularly concerned with nucleation devices for use in the making of photographic emulsions.

BACKGROUND OF THE INVENTION

Photographic emulsions comprise silver halide grains which are generally produced by reacting an aqueous silver salt solution, for example, silver nitrate, and an aqueous halide solution, for example, potassium bromide, in an aqueous colloid solution, for example, gelatin, in a reaction vessel. The silver halide grains are formed due to the precipitation of silver halide during the reaction. The grains are formed in two stages-nucleation and crystal growth. Nucleation is the process by which new grains are created and growth is the addition of new layers to the grains present. There is no increase in the number of silver halide grains during the growth step. The formation of silver halide grains is described in detail in *The Theory of the Photographic Process*, Fourth Edition, edited by T. H. James.

During the nucleation and crystal growth stages, two other processes occur at the same time. The first of these is Ostwald ripening which occurs predominantly at higher temperatures in the presence of solvents and where there is a wide distribution of grain sizes. The second process is recrystallization in which the composition of the grains changes.

It is known that the nucleus formation of silver halide grains is affected by the concentration of the silver ions or halide ions in the reaction solutions, the concentration of the silver halide solvent, the supersaturation, the temperature etc. The heterogeneity of silver ion or halogen ion concentration due to the addition of aqueous silver salt and halide solution added to a reaction vessel produces variations in supersaturation and solubility in the reaction vessel by each concentration so that the nucleus formation rate differs to produce a heterogeneity in the silver halide grain nuclei formed. In order to avoid heterogeneity, it is necessary to mix the aqueous silver salt solution with the aqueous halide solution being supplied to the aqueous colloid solution both quickly and uniformly to achieve homogenization of the silver ion or halide ion concentration in the reaction vessel.

U.S. Pat. No. 5,213,772 describes apparatus for providing silver halide grains having very fine grain sizes with a homogeneous grain size distribution. This is achieved by carrying out the steps of nucleation and crystal growth of the silver halide grains in a mixing vessel outside the reaction vessel. The mixing vessel has inlets for the aqueous colloid solution, the aqueous silver salt solution and the aqueous halide solution and an outlet connected to a reaction vessel. The mixing vessel also includes a high-speed stirring blade. The inlet for the colloid solution is arranged so that the solution is directed on to the rotary axis of the stirring blade. The inlets for the aqueous silver salt solution and aqueous halide solution are formed at opposite sides of the mixing vessel with respect to one another with the rotary axis of the stirrer between them. The flow rates of the aqueous silver salt solution and the aqueous halide solution are adjusted so that they do not mix with one another before they are each diluted with the aqueous colloid solution.

JP-A-04/139440 discloses a nozzle arrangement for mixing aqueous silver salt solutions with aqueous halide solutions. The nozzle comprises an elongate hollow body portion having two inlets, one for each of the component solutions. The body portion defines two conduit portions each extending from a respective one of the two inlets and into the body portion. Mixing and reacting of the two solutions is achieved at the exits of the two conduit portions to provide ultra fine silver halide grains which are then released into a reaction vessel containing a dispersion medium as the solute source for nuclei formation and/or crystal growth.

PROBLEM TO BE SOLVED BY THE INVENTION

In known arrangements for producing photographic emulsions, there is often local recycling of the material as it is mixed. This may produce secondary effects such as solid precipitation which effectively produces a chemical reaction short circuit.

Moreover, it may not be easy to control the size distribution of the grains produced during the reaction between the silver salt solution and the halide solution in the presence of the aqueous colloid solution due to uneven mixing.

SUMMARY OF THE INVENTION

It is an object of the present invention to provide an improved nucleation device which produces nuclei during a photographic emulsion process without the disadvantages associated with prior art devices.

In accordance with one aspect of the present invention, there is provided a device for mixing solutions, the device comprising:

a body having an interior;

a plurality of inlets connected to the interior of the body and through which solutions to be mixed are introduced;

mixing means in the body for mixing the introduced solutions;

an outlet connecting the interior of the body to the exterior thereof and through which mixed solutions are removed from the device;

characterized in that the inlets are connected to respective ones of a plurality of concentric orifices which direct the solutions to be mixed on to the mixing means.

The mixing means may provide a plurality of mixing zones, the number of mixing zones being one less than the number of concentric orifices.

The mixing means may comprise at least one mixing surface which is arranged substantially perpendicular to the direction of flow of the solutions from the concentric orifices.

Preferably, each mixing surface is formed on a rotor which is rotated about an axis by a motor. The rotor includes a disc element on to which at least two of the solutions impinge for mixing at a first mixing zone. The first mixing zone is substantially annular and centered about the axis of the rotor and at least one further mixing zone is provided on the disc element, each further mixing zone being substantially annular and located generally radially outwardly of the first mixing zone and substantially concentric therewith.

The rotor may further include at least one stepped annular element arranged to be substantially perpendicular to the disc element, the step of each annular element corresponding a further mixing zone, each concentric orifice terminating at a respective one of the further mixing zones.

Alternatively, each mixing surface is formed on a stator, the flow of solutions through each concentric orifices being adjusted to achieve mixing.

Preferably, the device is a nucleation device and the solutions being mixed are constituents which form photographic emulsions.

ADVANTAGEOUS EFFECT OF THE INVENTION

The device in accordance with the present invention produces grains which are the same size and shape as there is no local recycling of the material as it is mixed.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figure 1:
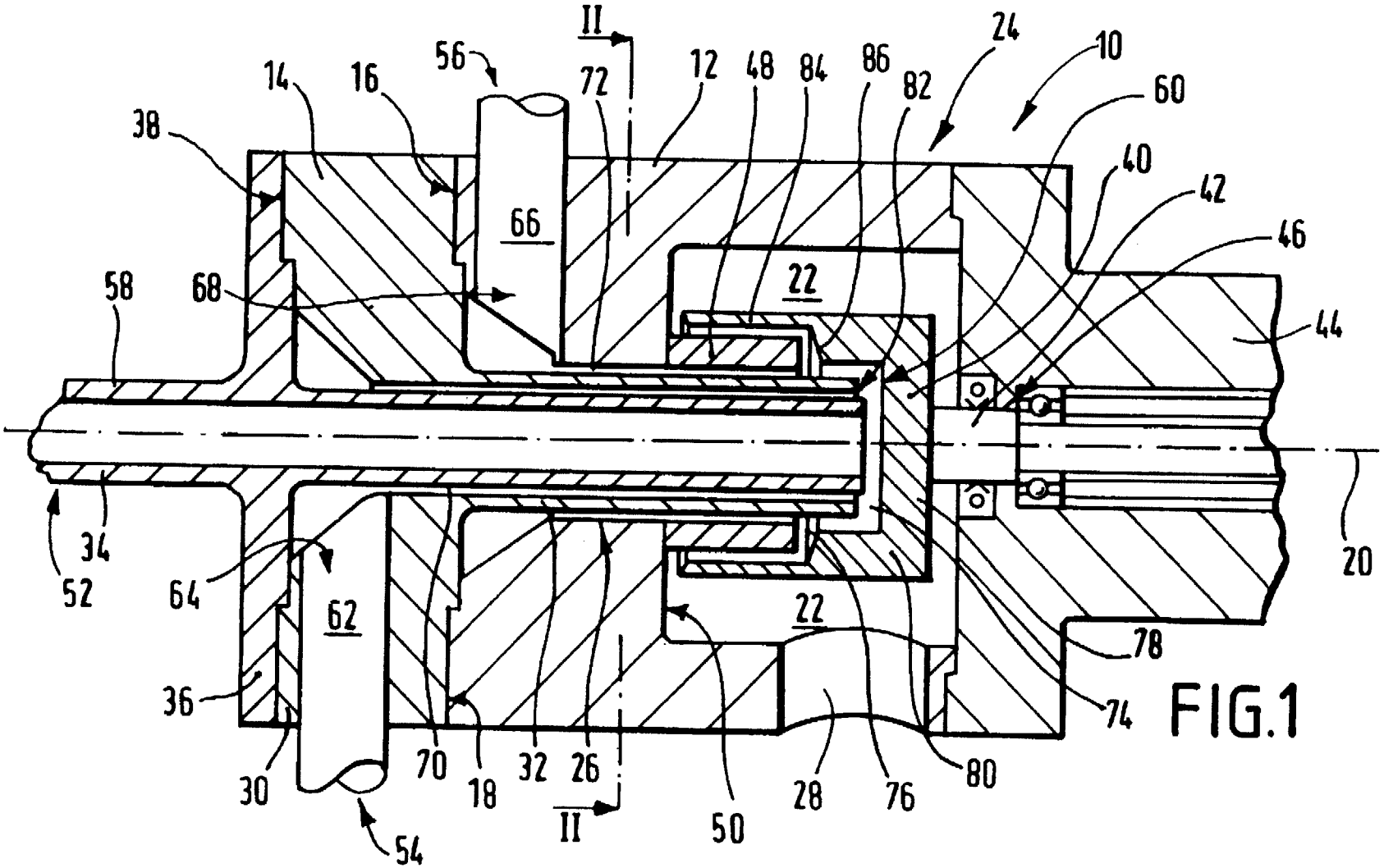
FIG. 1 is a schematic sectioned side elevation of a nucleation device in accordance with the present invention.

According to known photographic emulsion making techniques, three solutions are mixed together in appropriate ratios to form a desired photographic emulsion. A nucleation device in accordance with the present invention allows the three solutions, namely, an aqueous silver salt solution, an aqueous halide solution and an aqueous colloid solution, to mix together to produce the emulsion.

A nucleation device 10 in accordance with the present invention is shown in the Figures. The device 10 comprises body portions 12, 14 which abut one another along respective faces 16, 18. Body portions 12, 14 lie along a common longitudinal axis 20.

A recess 22 is symmetrically formed at one end 24 of body portion 12, and a bore 26 extends symmetrically about axis 20 from face 16 into recess 22. Recess 22 is connected to the exterior of body portion 12 by an exit port 28 formed therein.

Figure 2:
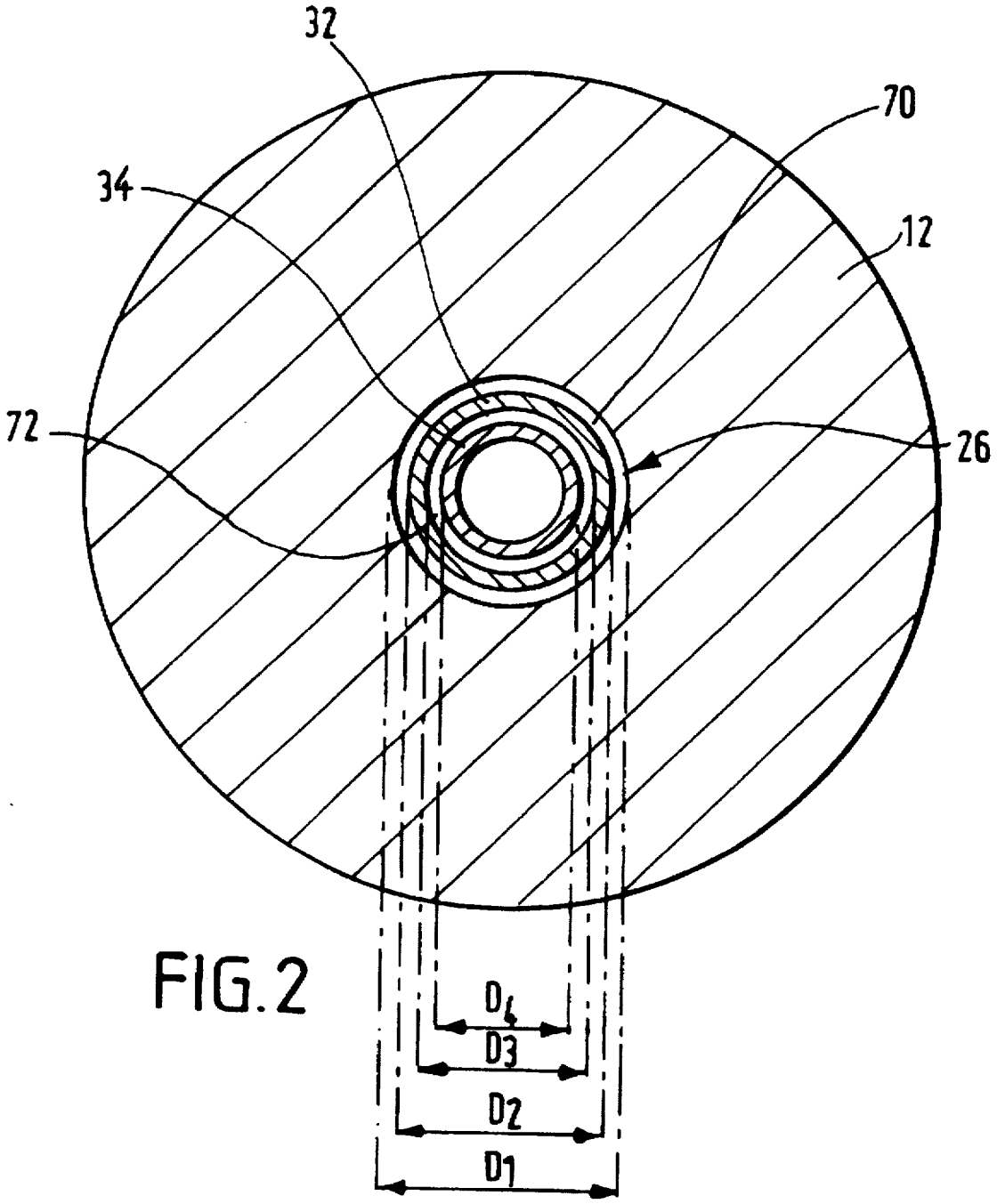
FIG. 2 is a sectioned view taken along lines II—II of FIG. 1.

Body portion 14 has a flange portion 30 and a central tube portion 32. Flange portion 30 has face 18 formed thereon which abuts with face 16 of body portion 12. Central tube portion 32 extends into bore 26 of body portion 12, and has an external diameter $D_2$ which is less than internal diameter $D_1$ of bore 26 formed in body portion 12 as shown in FIG. 2.

A tube member 34 is inserted into the tube portion 32 and is retained in position by flange member 36 which abuts face 38 of body portion 14. Tube member 34 (FIG. 2) has an external diameter $D_4$ which is smaller than internal diameter $D_3$ of central tube portion 32. Flange member 36 is held in place against face 38 by conventional fixing means (not shown for clarity).

A rotor member 40 is mounted symmetrically in recess 22 on longitudinal axis 20 and is connected to a drive shaft 42 attached to a motor (not shown). Recess 22 is closed by a housing 44 having an aperture 46 formed therein through which drive shaft 42 extends as shown in FIG. 1.

Body portion 12 has an annular member 48 attached to face 50, the annular member 48 extending into recess 22 so as to effectively extend bore 26 further into the recess 22. The annular member 48 also cooperates with the rotor member 40 as will be described in more detail later.

Three inlets 52, 54, 56 are provided in the device 10 for respective ones of the solutions required to mix the emulsion. Inlet 52 is provided by end 58 of tube member 34, the solution to be mixed being directed on to face 60 of rotor member 40. Inlet 54 is provided in body portion 14 by means of a tube 62 mounted in a bore 64 formed in body portion 14. Similarly, inlet 56 is provided in body portion 12 by means of a tube 66 mounted in a bore 68 formed in body portion 12.

Tubes 62, 66 provide fluid connection with respective passages 70, 72. Passage 70 is formed by internal wall surface of tube portion 32 of body 14 and external wall surface of tube member 34. Similarly, passage 72 is formed by internal wall surface of bore 26 of body portion 12, together with annular member 48 as described above, and external wall surface of tube portion 32 of body portion 14.

It will be readily appreciated that tube member 34 and passages 70, 72 provide a concentric tube arrangement, providing concentric orifices, in the vicinity of the rotor member 40.

In operation of the device 10, a salt solution (sodium chloride or potassium bromide) is introduced into the device 10 at inlet 52, an aqueous colloid solution (gelatin) at inlet 54, and a silver solution (silver nitrate) at inlet 56. The salt solution chosen depends on the type of emulsion being made, that is, either a chloride or bromide emulsion. The salt solution passes through tube member 34 and impinges on face 60 of rotor 40. Gelatin from inlet 54 passes through tube 62, into passage 70 and on to face 60 of rotor 40 adjacent the point where the salt solution exits tube member 34. Here, a first mixing zone 74 is provided where the gelatin mixes thoroughly with the salt solution before passing into a second mixing zone 76 to mix with the silver solution. The silver solution from inlet 56 passes through tube 66, into passage 72 and into the second mixing zone 76 formed in the recess 22 adjacent the end of annular member 48. Here, the silver solution mixes with the gelatin/salt mixture and precipitation of silver halide begins. The mixed solutions then pass from the second mixing zone 76, into the surrounding recess 22 and out through exit port 28.

Exit port 28 is connected to a growth stage for the precipitated silver halide grains, the growth stage not forming part of the present invention and will not be described further here.

It will be readily appreciated that the salt solution can be introduced into the device 10 at inlet 56 and the silver solution at inlet 52. Gelatin is introduced into inlet 54 before the other solutions are introduced into their respective inlets 52, 56 so that there is no risk that the salt and silver solutions can meet without being in the presence of gelatin.

The passages 70, 72 and interior of tube member 34 can be of any suitable size. For example, the tube member 34 may have an internal diameter of 12 mm, and passages 70, 72 comprise annular slots or orifices having respective outside diameters of 20 mm and 27 mm. Passages 70, 72 and tube member 34 provide a series of concentric orifices adjacent the rotor 40, each orifice apart from that corresponding to tube member 34, that is, the innermost orifice, is located at a respective one of the two mixing zone 74, 76.

Mixed solutions may have an output flow rate of up to at least 60 l/min. Preferably, a flow rate of 30 l/min is used. The solutions can be mixed according to any desired ratio, the flow rate being adjusted accordingly.

The rotor 40 is rotated at speed by the motor (not shown) via drive shaft 46 to provide the mixing action in both mixing zones 74, 76. The rotor 40 is rotated at a speed up to around 6000 rpm. The motor driving the rotor 40 via drive shaft 46 may be a variable speed motor.

The rotor 40 of the illustrated embodiment is shaped to provide, in conjunction with the annular member 48, mixing zones 74, 76. The rotor 40 effectively comprises a disc portion 78 on which face 60 is provided, a first annular portion 80 which surrounds open end 82 of tube member 34 and tube portion 32 of body portion 14, and a second annular portion 84 which substantially surrounds annular member 48. Face 60 of disc portion 78 extends generally perpendicular to the direction of flow of the solutions from tube member 34 and passage 70. The first and second annular portions 80, 84 are stepped in respect to one another so as to have increased diameters. They are joined together by a shoulder portion 86 which in conjunction with annular member 48 forms the second mixing zone 76, shoulder portion 86 forming a step.

Although the rotor 40 of the described embodiment is shaped, it may solely comprise a disc member (not shown) mounted for rotation about axis 20. The disc member provides two mixing zones which respectively comprise two generally annular concentric regions spaced radially outwardly over the surface of the disc member from the axis 20.

By having a rotating disc member, there is no build up of mixed solution and the disc member can be considered to be 'self-clearing'. Furthermore, compensation for any imbalances in the face 60 due to machining and/or assembly of the device can be provided.

Generally, the speed of rotation of the disc member or rotor is not critical for satisfactory mixing—for example, a high solution flow rate may be used with a low speed of rotation, or conversely, a low solution flow rate with a high speed of rotation.

It will be readily appreciated that although three concentric orifices have been described in relation to the embodiment of the present invention, it is possible to have a greater or less number of orifices and hence mixing zones. For example, in a further embodiment of the present invention (not illustrated), there may be six inlets to the device, each inlet terminating in a respective one of six concentric orifices. In such a case, if three of the inlets are connected for delivery of gelatin, silver solution and salt solution as described above, the other three inlets may be connected for the delivery of other suitable materials which it is desired to add during the mixing of the photographic emulsion, for example, water, dopants, and other polymeric materials.

Alternatively, the device may only have two ports and two concentric orifices—in this case, both the silver (silver nitrate) and salt (potassium bromide or sodium chloride) solutions are pre-mixed or diluted with the aqueous colloid solution (gelatin) before being introduced into the device. Such an embodiment provides a single mixing zone and is within the scope of the present invention.

Generally speaking, the number of mixing zones is one less than the number of inlets to the device and hence the number of concentric orifices.

Although the exit port 28 of the device 10 is described as being formed in a side wall thereof, a coaxial exit port (not illustrated) may be preferred. In this case, the drive shaft which connects the drive motor to the rotor would extend axially through tube member 34 and be attached to the rotor at a point substantially at its centre. Preferably, the rotor 46 will solely comprise a disc member as described above, the member being suitably profiled to prevent the formation of 'dead' zones where thorough mixing is not achieved. For example, the face 60 on to which the solutions impinge could form the base of a cone. It will be readily understood that such a modification to the device of the present invention will not affect the operation of the device.

Although the present invention is described as having a rotating disc member on which the solutions to be mixed impinge, the disc member may comprise a stator on which the solutions are mixed. In this case, the solutions would be pumped through the device at suitable flow rates to achieve the desired mixing.

It will be readily understood that although the present invention has been described as a nucleation device for producing silver halide grains in the production of photographic emulsions, the device described herein can be used in any situation where it is desired to mix a plurality of solutions together and is not therefore limited to use in the photographic industry.

We claim:

1. A device for mixing photographic solutions, the device comprising:

a body having an interior;

a plurality of solutions for introducing into the interior of the body; mixing means in the interior of the body for mixing the solutions comprising at least one mixing surface which is arranged substantially perpendicular to the direction of flow of the solutions orifices wherein each mixing surface is formed on a rotor which is rotated;

a rotor on which each of the at least one mixing surfaces is formed, the rotor being rotated about an axis by a motor;

a disc element included on the rotor;

a first mixing zone provided on the disc element, said mixing zone being substantially annular and being centered about the axis of the rotor, at which mixing zone at least two of the solutions impinge for mixing;

at least one further mixing zone provided on the disc element, the at least one further mixing zone being substantially annular and being located radially outwardly of the first mixing zone and substantially concentric therewith;

at least one annular element having steps, said at least one annular element being included on the rotor and arranged to be substantially perpendicular to the disc element;

a further mixing zone corresponding to the step of the at least one annular element for mixing the solutions;

a plurality of inlets connected to the interior of the body and through which solutions to be mixed are introduced;

a plurality of concentric orifices connected to respective ones of said inlets, the concentric orifices directing the solutions to be mixed onto the mixing means providing a plurality of mixing zones;

an outlet connecting the interior of the body to the exterior thereof and through which the mixed solutions can be removed from the device; characterized in that each of the concentric orifices terminates at a respective one of the mixing zones.

2. A device according to claim 1, wherein the number of mixing zones is one less than the number of concentric orifices.

* * * * *

UNITED STATES PATENT AND TRADEMARK OFFICE

CERTIFICATE OF CORRECTION

PATENT NO. : 5,690,428
DATED : November 25, 1997
INVENTOR(S) : Michael Bryan, et al It is certified that error appears in the above-identified patent and that said Letters Patent is hereby corrected as shown below:

Column 6, lines 26-28 delete "orifices wherein each mixing surface is formed on a rotor which is rotated"

Signed and Sealed this

Seventeenth Day of February, 1998

Bruce Lehman

*Attest:*

BRUCE LEHMAN

*Attesting Officer*

*Commissioner of Patents and Trademarks*